US006858259B2

(12) United States Patent
Affinito et al.

(10) Patent No.: US 6,858,259 B2
(45) Date of Patent: Feb. 22, 2005

(54) PLASMA ENHANCED CHEMICAL DEPOSITION FOR HIGH AND/OR LOW INDEX OF REFRACTION POLYMERS

(75) Inventors: John D. Affinito, Tucson, AZ (US); Gordon L. Graff, West Richland, WA (US); Peter M. Martin, Kennewick, WA (US); Mark E. Gross, Pasco, WA (US); Paul E. Burrows, Kennewick, WA (US); Linda S. Sapochak, Henderson, NV (US)

(73) Assignee: Battelle Memorial Institute, Richland, WA (US)

( * ) Notice: Subject to any disclaimer, the term of this patent is extended or adjusted under 35 U.S.C. 154(b) by 0 days.

(21) Appl. No.: 09/811,919

(22) Filed: Mar. 19, 2001

(65) Prior Publication Data

US 2004/0009306 A1 Jan. 15, 2004

Related U.S. Application Data

(63) Continuation-in-part of application No. 09/212,776, filed on Dec. 16, 1998, now Pat. No. 6,207,238.

(51) Int. Cl.[7] ..... H05H 1/00

(52) U.S. Cl. ..... 427/488; 427/512; 427/569; 427/398.1

(58) Field of Search ..... 427/488, 509, 427/512, 569, 398.1

(56) References Cited

U.S. PATENT DOCUMENTS

| | | | |
|---|---|---|---|
| 3,475,307 | A | 10/1969 | Knox et al. |
| 3,607,365 | A | 9/1971 | Lindlof |
| 4,098,965 | A | 7/1978 | Kinsman |
| 4,283,482 | A | 8/1981 | Hattori et al. |
| 4,581,337 | A | 4/1986 | Frey et al. |
| 4,624,867 | A | 11/1986 | Iijima et al. |
| 4,695,618 | A | 9/1987 | Mowrer |
| 4,842,893 | A | 6/1989 | Yializis et al. |
| 4,954,371 | A | 9/1990 | Yializis |
| 5,032,461 | A | 7/1991 | Shaw et al. |
| 5,204,314 | A | 4/1993 | Kirlin et al. |
| 5,237,439 | A | 8/1993 | Misono et al. |
| 5,260,095 | A | 11/1993 | Affinito |
| 5,354,497 | A | 10/1994 | Fukuchi et al. |
| 5,395,644 | A | 3/1995 | Affinito |
| 5,427,638 | A | 6/1995 | Goetz et al. |
| 5,440,446 | A | 8/1995 | Shaw et al. |
| 5,536,323 | A | 7/1996 | Kirlin et al. |
| 5,547,508 | A | 8/1996 | Affinito |
| 5,554,220 | A | 9/1996 | Forrest et al. |
| 5,576,101 | A | 11/1996 | Saitoh et al. |
| 5,607,789 | A | 3/1997 | Treger et al. |
| 5,620,524 | A | 4/1997 | Fan et al. |
| 5,629,389 | A | 5/1997 | Roitman et al. |
| 5,652,192 | A | 7/1997 | Matson et al. |
| 5,654,084 | A | 8/1997 | Egert |
| 5,665,280 | A | 9/1997 | Tropsha |
| 5,681,615 | A | 10/1997 | Affinito et al. |
| 5,681,666 | A | 10/1997 | Treger et al. |
| 5,684,084 | A | 11/1997 | Lewin et al. |

(List continued on next page.)

FOREIGN PATENT DOCUMENTS

| | | |
|---|---|---|
| BE | 704 297 | 2/1968 |
| DE | 19603746 | 4/1997 |
| EP | 0 299 753 | 1/1989 |
| EP | 0 340 935 | 11/1989 |
| EP | 0 390 540 | 10/1990 |
| EP | 0 547 550 | 6/1993 |
| EP | 0 590 467 | 4/1994 |
| EP | 0 722 787 | 7/1996 |
| EP | 0 787 826 | 8/1997 |
| EP | 0 916 394 | 5/1999 |
| EP | 0 931 850 | 7/1999 |
| EP | 0 977 469 | 2/2000 |
| JP | 63136316 | 6/1988 |
| JP | 64-18441 | 1/1989 |
| JP | 2-183230 | 7/1990 |
| JP | 08325713 | 12/1996 |
| JP | 09059763 | 3/1997 |
| WO | WO 87 07878 | 12/1987 |
| WO | WO 95 10117 | 4/1995 |
| WO | WO 97 04885 | 2/1997 |
| WO | WO 97 22631 | 6/1997 |
| WO | WO 98 18852 | 5/1998 |
| WO | WO 99 16557 | 4/1999 |
| WO | WO 99 16931 | 4/1999 |
| WO | WO 00/36665 | 6/2000 |
| WO | WO 01/81649 A1 | 11/2001 |
| WO | WO 01/82336 A2 | 11/2001 |
| WO | WO 01/82389 A1 | 11/2001 |
| WO | WO 01/89006 A1 | 11/2001 |

OTHER PUBLICATIONS

Affinito, J.D., et al., "Vacuum Deposition of Polymer Electrolytes on Flexible Substrates," "Proceedings of the Ninth International Conference on Vacuum Web Coating," Nov. 1995 ed R. Bakish, Bakish Press 1995, p. 20–36.

Vossen, J.L., et al., Thin Film Processes, Academic Press, 1978, Part II, Chapter 11–1, Glow Discharge Sputter Deposition, p. 12–63; Part IV, Chapter IV–I, Plasma Deposition of Inorganic Compounds and Chapter IV–2 Glow Discharge Polymerization, p. 335–397.

(List continued on next page.)

*Primary Examiner*—Bret Chen
(74) *Attorney, Agent, or Firm*—Dinsmore & Shohl LLP

(57) ABSTRACT

A method for making a polymer layer with a selected index of refraction. The method includes flash evaporating a polymer precursor material capable of cross linking into a polymer with the selected index of refraction, forming an evaporate, passing the evaporate to a glow discharge electrode creating a glow discharge polymer precursor plasma from the evaporate, and cryocondensing the glow discharge polymer precursor plasma on a substrate as a condensate and crosslinking the condensate thereon, the crosslinking resulting from radicals created in the glow discharge polymer precursor plasma, forming a polymer having the selected index of refraction.

26 Claims, 4 Drawing Sheets

U.S. PATENT DOCUMENTS

| | | | | |
|---|---|---|---|---|
| 5,686,360 | A | | 11/1997 | Harvey, III et al. |
| 5,693,956 | A | | 12/1997 | Shi et al. |
| 5,711,816 | A | | 1/1998 | Kirlin et al. |
| 5,725,909 | A | | 3/1998 | Shaw et al. |
| 5,731,661 | A | | 3/1998 | So et al. |
| 5,747,182 | A | | 5/1998 | Friend et al. |
| 5,757,126 | A | | 5/1998 | Harvey, III et al. |
| 5,759,329 | A | | 6/1998 | Krause et al. |
| 5,792,550 | A | | 8/1998 | Phillips et al. |
| 5,811,177 | A | | 9/1998 | Shi et al. |
| 5,811,183 | A | | 9/1998 | Shaw et al. |
| 5,821,692 | A | | 10/1998 | Rogers et al. |
| 5,844,363 | A | | 12/1998 | Gu et al. |
| 5,872,355 | A | | 2/1999 | Hueschen |
| 5,902,641 | A | | 5/1999 | Affinito et al. |
| 5,902,688 | A | | 5/1999 | Antoniadis et al. |
| 5,904,958 | A | | 5/1999 | Dick et al. |
| 5,912,069 | A | | 6/1999 | Yializis et al. |
| 5,919,328 | A | | 7/1999 | Tropsha et al. |
| 5,922,161 | A | | 7/1999 | Wu et al. |
| 5,945,174 | A | | 8/1999 | Shaw et al. |
| 5,948,552 | A | | 9/1999 | Antoniadis et al. |
| 5,955,161 | A | | 9/1999 | Tropsha |
| 5,965,907 | A | | 10/1999 | Huang et al. |
| 5,968,620 | A | | 10/1999 | Harvey et al. |
| 5,996,498 | A | | 12/1999 | Lewis |
| 6,013,337 | A | | 1/2000 | Knors |
| 6,045,864 | A | | 4/2000 | Lyons et al. |
| 6,083,628 | A | | 7/2000 | Yializis |
| 6,092,269 | A | | 7/2000 | Yializis et al. |
| 6,106,627 | A | | 8/2000 | Yializis |
| 6,146,225 | A | | 11/2000 | Sheats et al. |
| 6,165,566 | A | | 12/2000 | Tropsha |
| 6,207,238 | B1 | * | 3/2001 | Affinito ..... 427/488 |
| 6,207,239 | B1 | | 3/2001 | Affinito |
| 6,214,422 | B1 | | 4/2001 | Yializis |
| 6,217,947 | B1 | | 4/2001 | Affinito |
| 6,224,948 | B1 | | 5/2001 | Affinito |
| 6,228,434 | B1 | | 5/2001 | Affinito |
| 6,228,436 | B1 | | 5/2001 | Affinito |
| 6,231,939 | B1 | | 5/2001 | Shaw et al. |
| 6,274,204 | B1 | | 8/2001 | Affinito |
| 6,497,924 | B2 | | 12/2002 | Affinito et al. |
| 6,509,065 | B2 | | 1/2003 | Affinito |
| 6,544,600 | B2 | | 4/2003 | Affinito et al. |
| 6,613,395 | B2 | | 9/2003 | Affinito et al. |
| 6,627,267 | B2 | | 9/2003 | Affinito |
| 6,656,537 | B2 | | 12/2003 | Affinito et al. |
| 2002/0102363 | A1 | | 8/2002 | Affinito et al. |
| 2002/0125822 | A1 | | 9/2002 | Graff et al. |
| 2003/0235648 | A1 | | 12/2003 | Affinito et al. |

OTHER PUBLICATIONS

Penning, F.M., Electrical Discharges In Gasses, Gordon and Breach Science Publishers, 1965, Chapters 5–6, p. 19–35, and Chapter 8, p. 41–50.

Affinito, J.D., et al, "High Rate Vacuum Deposition of Polymer Electrolytes," Journal Vacuum Science Technology A 14(3), May/Jun. 1996, no page numbers.

Inoue et al., Fabrication of a Thin Film of MNA by Vapour Deposition, Proc. Jpn. Congr. Mater. Res., vol. 33, p. 177–9, 1990.

Affinito, J.D. et al., "PML/Oxide/PML Barrier Layer Performance Differences Arising From Use of UV or Electron Beam Polymerizaton of the PML Layers," Thin Solid Films, Elsevier Science S.A., vol. 308–309, Oct. 31, 1997, pp. 19–25.

Gustafsson, G. et al, "Flexible light–emitting diodes made from soluble conducting polymers," Nature, vol. 357, Jun. 11, 1992, pp. 447–479.

Affinito, J.D. et al., "Polymer–Oxide Transparent Barrier Layers," SVC 39th Annual Technical Conference, Vacuum Web Coating Session, 1996, pp. 392–397.

Affinito, J.D. et al, "PML/Oxide/PML Barrier Layer Performance Differences Arising From Use of UV or Electron Beam Polymerization of the PML Layers," SVC 40th Annual Technical Conference, 1997, pp. 19–25.

Wong, C.P., "Recent Advances in IC Passivation and Encapsulation: Process Techniques and Materials," Polymers for Electronic and Photonic Applications, AT&T Bell Laboratories, 1993, pp. 167–209.

De Gryse, R. et al., Sputtered Transparent Barrier Layers, pp. 190–198, no date available.

Tropsha et al., "Activated Rate Theory Treatment of Oxygen and Water Transport through Silicon Oxide/Poly(ethylene terephthalate) Composite Barrier Structures," J. Phys. Chem B 1997, pp. 2259–2266.

Tropsha et al., "Combinatorial Barrier Effect of the Multilayer $SiO_x$ Coatings on Polymer Substrates," 1997 Society of Vacuum Coaters, 40th Annual Technical Conference Proceedings, no page numbers.

Phillips et al., "Evaporated Dielectric Colorless Films on PET and OPP Exhibiting High Barriers Toward Moisture and Oxygen," Society of Vacuum Coaters, 36th Annual Technical Conference Proceedings (1993), pp. 293–300.

Chahroudi, Transparent Glass Barrier Coatings for Flexible Film Packaging, Society of Vacuum Coaters, 34th Annual Technical Conference Proceedings (1991), pp. 130–133.

Yamada et al., "The Properties of a New Transparent and Colorless Barrier Film," Society of Vacuum Coaters, 38th Annual Technical Conference Proceedings (1995), pp. 28–31.

Affinito, J.D. et al., "Molecularly Doped Polymer Composite Films for Light Emitting Polymer Applications Fabricated by the PML Process" 1998 Society of Vaccum Coaters, 41st Annual Technical Conference Proceedings (1998), pp. 220–225.

Shi, M.K., et al., Plasma treatment of PET and acrylic coating surfaces—I. In situ XPS measurements, Journal of Adhesion Science and Technology, Mar. 2000, 14(12), pp. 1–28.

Shi, M.K., et al., In situ and real–time monitoring of plasma–induced etching PET and acrylic films, Plasmas and Polymers, Dec. 1999, 4(4), pp. 1–25.

Affinito, J.D., et al., Vacuum Deposited Conductive Polymer Films, The Eleventh International Conference on Vacuum Web Coating, no earlier than Feb. 1998, pp. 200–213.

Mahon, J.K., et al., Requirements of Flexible Substrates for Organic Light Emitting Devices in Flat Panel Display Applications, Society of Vacuum Coaters, 42nd Annual Technical Conference Proceedings, 1999, pp. 456–459.

Mahon, J.K., et al., Requirements of Flexible Substrates for Organic Light Emitting Devices in Flat Panel Display Applications, Society of Vacuum Coaters, 42nd Annual Technical Conference Proceedings, Oct. 1999, pp. 456–459.

* cited by examiner

DIALLYLDIPHENYLSILANE
n=1.575
Fig. 6a
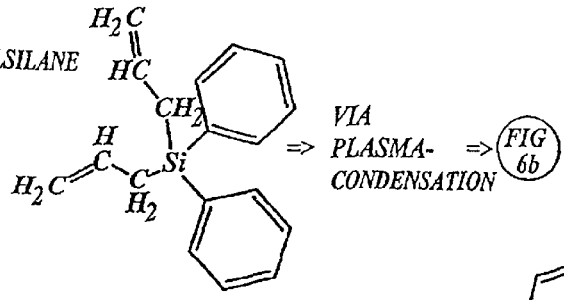
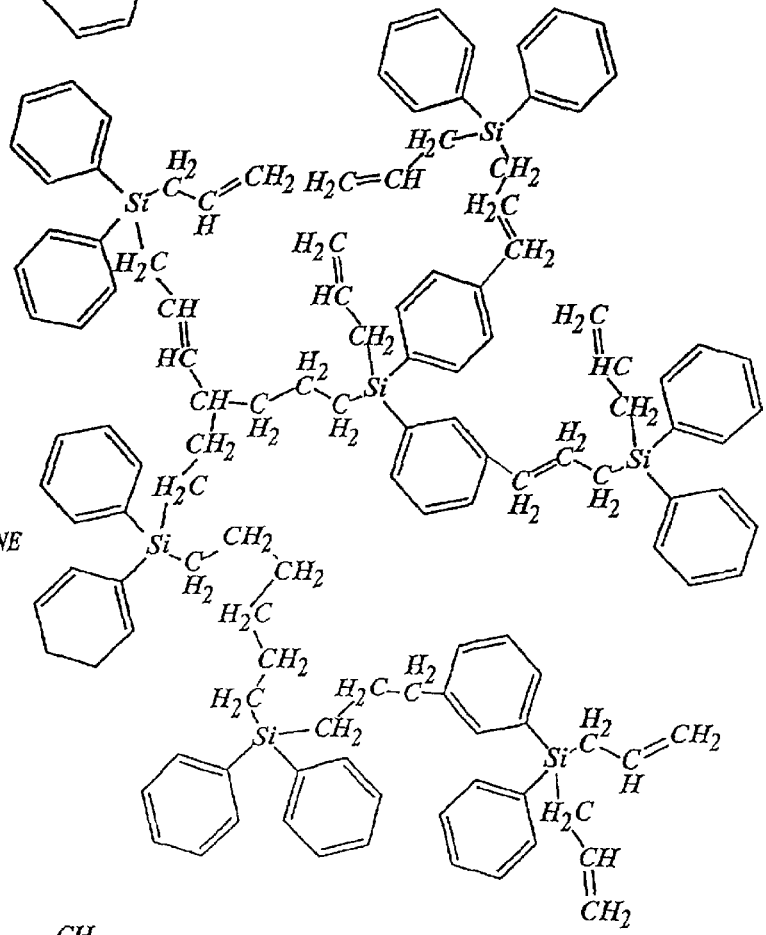
POLY-DIALLYLDIPHENYLSILANE
n ~ 1.6 - 1.65
Fig. 6b
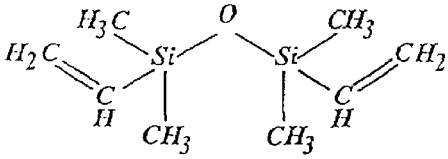
1,3-DIVINYLTETRAMETHYLDISILOXANE
n=1.4123
Fig. 7a
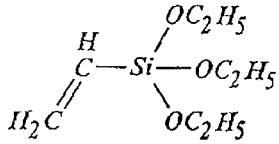
VINYLTRIETHOXYSILANE
n=1.396
Fig. 7b

PLASMA ENHANCED CHEMICAL DEPOSITION FOR HIGH AND/OR LOW INDEX OF REFRACTION POLYMERS

FIELD OF THE INVENTION

This application is a continuation in part of application Ser. No. 09/212,776 now U.S. Pat. No. 6,207,238, filed Dec. 16, 1998, entitled "Plasma Enhanced Chemical Deposition for High and/or Low Index of Refraction Polymers."

The present invention relates generally to a method of making plasma polymerized films having a specified index of refraction. More specifically, the present invention relates to selecting certain polymer precursors to obtain a desired index of refraction of a plasma polymerized polymer film via plasma enhanced chemical deposition with a flash evaporated feed source of a low vapor pressure compound.

As used herein, the term "(meth)acrylic" is defined as "acrylic or methacrylic." Also, "(meth)acrylate" is defined as "acrylate or methacrylate."

As used herein, the term "cryocondense" and forms thereof refers to the physical phenomenon of a phase change from a gas phase to a liquid phase upon the gas contacting a surface having a temperature lower than a dew point of the gas.

As used herein, the term "polymer precursor" includes monomers, oligomers, and resins, and combinations thereof. As used herein, the term "monomer" is defined as a molecule of simple structure and low molecular weight that is capable of combining with a number of like or unlike molecules to form a polymer. Examples include, but are not limited to, simple acrylate molecules, for example, hexanedioldiacrylate, or tetraethyleneglycoldiacrylate, styrene, methyl styrene, and combinations thereof. The molecular weight of monomers is generally less than 1000, while for fluorinated monomers, it is generally less than 2000. Substructures such as $CH_3$, t-butyl, and CN can also be included. Monomers may be combined to form oligomers and resins, but do not combine to form other monomers.

As used herein, the term "oligomer" is defined as a compound molecule of at least two monomers that can be cured by radiation, such as ultraviolet or electron beam, glow discharge resins. Low molecular weight is defined herein as about 1000 to about 20,000 exclusive of fluorinated monomers. Oligomers are usually liquid or easily liquifiable. Oligomers do not combine to form monomers.

As used herein, the term "resin" is defined as a compound having a higher molecular weight (generally greater than 20,000) which is generally solid with no definite melting point. Examples include, but are not limited to, polystyrene resin, epoxy polyamine resin, phenolic resin, and acrylic resin (for example, polymethylmethacrylate), and combinations thereof.

BACKGROUND OF THE INVENTION

The basic process of plasma enhanced chemical vapor deposition (PECVD) is described in THIN FILM PROCESSES, J. L. Vossen, W. Kern, editors, Academic Press, 1978, Part IV, Chapter IV-1 Plasma Deposition of Inorganic Compounds, Chapter IV-2 Glow Discharge Polymerization, herein incorporated by reference. Briefly, a glow discharge plasma is generated on an electrode that may be smooth or have pointed projections. Traditionally, a gas inlet introduces high vapor pressure monomeric gases into the plasma region wherein radicals are formed so that upon subsequent collisions with the substrate, some of the radicals in the monomers chemically bond or cross link (cure) on the substrate. The high vapor pressure monomeric gases include gases of $CH_4$, $SiH_4$, $C_2H_6$, $C_2H_2$, or gases generated from high vapor pressure liquid, for example styrene (10 torr at 87.4° F. (30.8° C.)), hexane (100 torr at 60.4° F. (15.8° C.)), tetramethyldisiloxane (10 torr at 82.9° F. (28.3° C.)), 1,3,-dichlorotetramethyldisiloxane (75 torr at 44.6° F. (7.0° C.)), and combinations thereof that maybe evaporated with mild controlled heating. Because these high vapor pressure monomeric gases do not readily cryocondense at ambient or elevated temperatures, deposition rates are low (a few tenths of micrometer/min maximum) relying on radicals chemically bonding to the surface of interest instead of cryocondensation. Remission due to etching of the surface of interest by the plasma competes with the reactive deposition. Lower vapor pressure species have not been used in PECVD because heating the higher molecular weight monomers to a temperature sufficient to vaporize them generally causes a reaction prior to vaporization, or metering of the gas becomes difficult to control, either of which is inoperative.

The basic process of flash evaporation is described in U.S. Pat. No. 4,954,371 herein incorporated by reference. This basic process may also be referred to as polymer multi-layer (PML) flash evaporation. Briefly, a radiation polymerizable and/or cross linkable material is supplied at a temperature below a decomposition temperature and polymerization temperature of the material. The material is atomized to droplets having a droplet size ranging from about 1 to about 50 microns. An ultrasonic atomizer is generally used. The droplets are then flash vaporized, under vacuum, by contact with a heated surface above the boiling point of the material, but below the temperature which would cause pyrolysis. The vapor is cryocondensed on a substrate then radiation polymerized or cross linked as a very thin polymer layer.

The material may include a base monomer or mixture thereof, cross linking agents and/or initiating agents. A disadvantage of the flash evaporation is that it requires two sequential steps, cryocondensation followed by curing or cross linking, that are both spatially and temporally separate.

According to the state of the art of making plasma polymerized films, PECVD and flash evaporation or glow discharge plasma deposition and flash evaporation have not been used in combination. However, plasma treatment of a substrate using glow discharge plasma generator with inorganic compounds has been used in combination with flash evaporation under a low pressure (vacuum) atmosphere as reported in J. D. Affinito, M. E. Gross, C. A. Coronado, and P. M. Martin, "Vacuum Deposition Of Polymer Electrolytes On Flexible Substrates," Proceedings of the Ninth International Conference on Vacuum Web Coating, November 1995, ed. R. Bakish, Bakish Press 1995, pg. 20–36, and as shown in FIG. 1*a*. In that system, the plasma generator 100 is used to etch the surface 102 of a moving substrate 104 in preparation to receive the monomeric gaseous output from the flash evaporation 106 that cryocondenses on the etched surface 102 and is then passed by a first curing station (not shown), for example electron beam or ultra-violet radiation, to initiate cross linking and curing. The plasma generator 100 has a housing 108 with a gas inlet 110. The gas may be oxygen, nitrogen, water or an inert gas, for example argon, or combinations thereof. Internally, an electrode 112 that is smooth or having one or more pointed projections 114 produces a glow discharge and makes a plasma with the gas which etches the surface 102. The flash evaporator 106 has a housing 116, with a monomer inlet 118 and an atomizing nozzle 120, for example an ultrasonic atomizer. Flow through the nozzle 120 is atomized into particles or droplets 122 which strike the heated surface 124 whereupon the particles or droplets 122 are flash evaporated into a gas that flows past a series of baffles 126 (optional) to an outlet 128 and cryocondenses on the surface 102. Although other gas flow distribution arrangements have been used, it has been found that the baffles 126 provide adequate gas flow distribution or uniformity while permitting ease of scaling up to large surfaces 102. A curing station (not shown) is located downstream of the flash evaporator 106.

In all of these prior art methods, the starting monomer is a (meth)acrylate monomer (FIG. 1*b*). When $R_1$ is hydrogen (H), the compound is an acrylate and when $R_1$ is a methyl group ($CH_3$), the compound is a methacrylate.

It is known that the monomer composition may be varied to selectively obtain a desired refractive index. Acrylated or methacrylated hydrocarbon chain compositions provide indices of refraction tightly grouped about 1.5. Bisphenyl A diacrylate has an index of refraction of 1.53. The degree of conjugation (the number of carbon to carbon double or triple bonds or aromatic rings) generally increases index of refraction. For example, polyvinylcarbizone has an index of refraction of 2.1 or higher. However, multi-ring system compounds that are solids are not useful as a monomer in these systems. The addition of bromine may increase index of refraction as high as 1.7. The addition of fluorine may reduce index of refraction to as low as 1.3. However, bromine adds a brown color and tends to oxidize over time, and fluorinated monomers have high vapor pressures, poor adhesion and high cost.

Therefore, there is a need for a method for making plasma polymerized polymer layers at a fast rate but that is also self curing, and with selective index of refraction.

SUMMARY OF THE INVENTION

The present invention is an improved method of plasma polymerization wherein a polymer precursor capable of providing a polymer with a desired index of refraction is cured during plasma polymerization.

The present invention may be viewed as a method for plasma enhanced chemical vapor deposition of low vapor pressure polymer precursor or a mixture of polymer precursor with particle materials onto a substrate, or as a method for making self-curing polymer layers, especially self-curing PML polymer layers. From both points of view, the invention is a combination of flash evaporation with plasma enhanced chemical vapor deposition (PECVD) that provides the unexpected improvements of permitting use of low vapor pressure polymer precursor materials in a PECVD process and provides a self-curing polymer from a flash evaporation process, at a rate surprisingly faster than standard PECVD deposition rates.

The method of the present invention includes flash evaporating a liquid polymer precursor forming an evaporate, passing the evaporate to a glow discharge electrode creating a glow discharge polymer precursor plasma from the evaporate, and cryocondensing the glow discharge polymer precursor plasma on a substrate as a condensate and crosslinking the condensate thereon, the crosslinking resulting from radicals created in the glow discharge plasma.

Accordingly, the present invention provides a method of making a polymer with a selected index of refraction.

BRIEF DESCRIPTION OF THE DRAWINGS

FIG. 6*a* is a chemical diagram of diallyldiphenylsilane.

FIG. 6*b* is a chemical diagram of polydiallylphenylsilane.

FIG. 7*a* is a chemical diagram of divinyltetramethyldisiloxane.

FIG. 7*b* is a chemical diagram of vinyltriethoxysilane.

DETAILED DESCRIPTION OF THE INVENTION

Figure 1A:
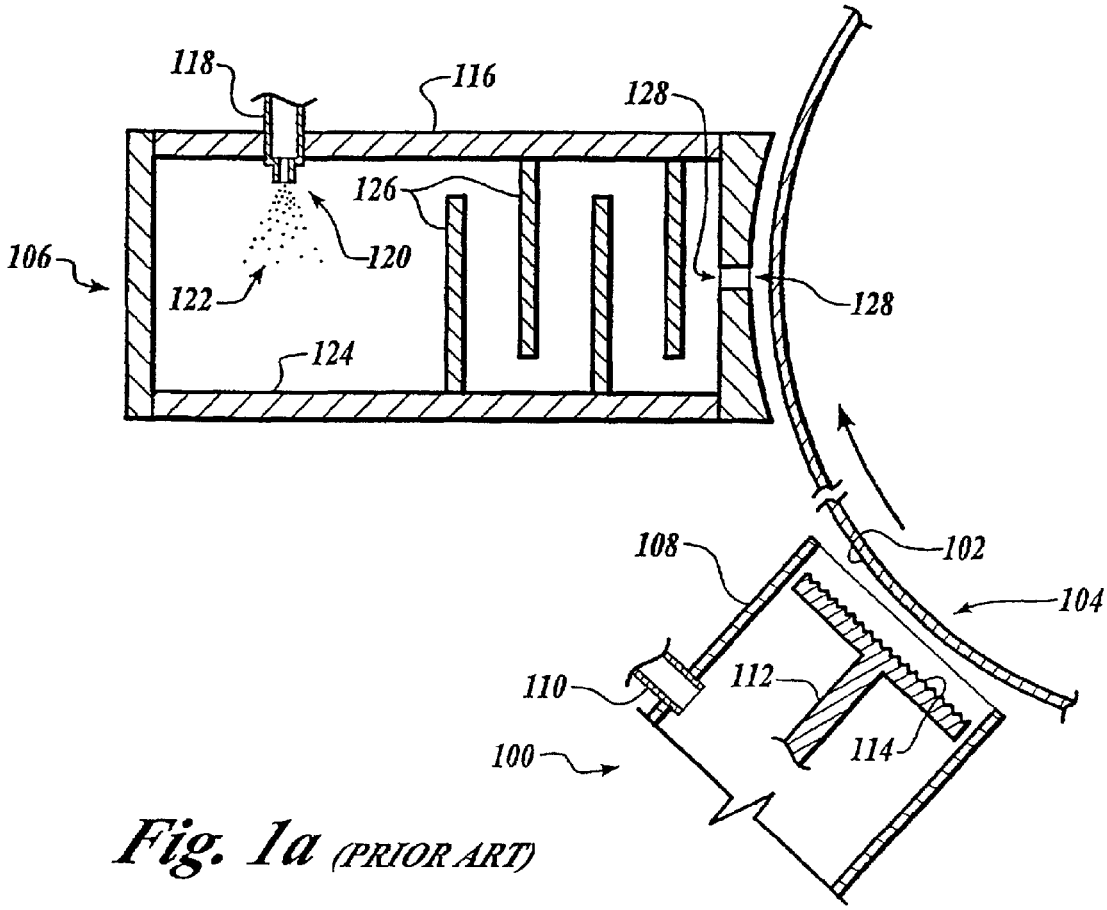
Fig. 1a (PRIOR ART)
FIG. 1*a* is a cross section of a prior art combination of a glow discharge plasma generator with inorganic compounds with flash evaporation.
Figure 1B:
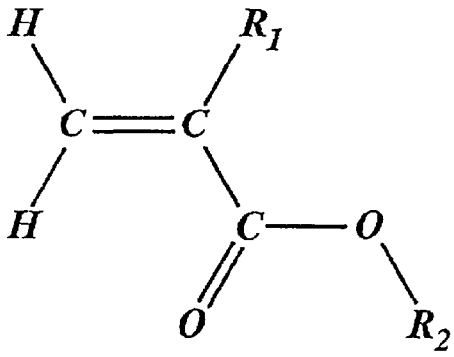
Fig. 1b (PRIOR ART)
FIG. 1*b* is a chemical diagram of (meth)acrylate.
Figure 2:
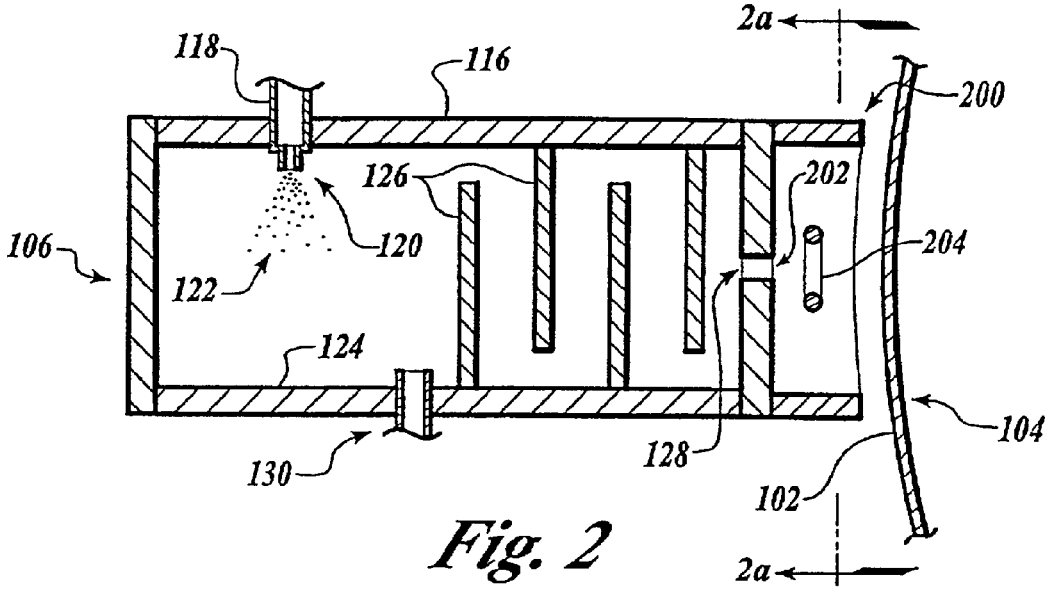
FIG. 2 is a cross section of an apparatus which can be used in the present invention of combined flash evaporation and glow discharge plasma deposition.

An apparatus which can be used in the method of the present invention is shown in FIG. 2. The method of the present invention may be performed within a low pressure (vacuum) environment or chamber. Pressures typically range from about $10^{-1}$ torr to $10^{-6}$ torr, although higher or lower pressures can be used. The flash evaporator 106 has a housing 116, with a polymer precursor inlet 118 and an atomizing nozzle 120. Flow through the nozzle 120 is atomized into particles or droplets 122 which strike the heated surface 124 whereupon the particles or droplets 122 are flash evaporated into a gas or evaporate that flows past a series of baffles 126 to an evaporate outlet 128 and cryocondenses on the surface 102. Cryocondensation on the baffles 126 and other internal surfaces is prevented by heating the baffles 126 and other surfaces to a temperature in excess of a cryocondensation temperature or dew point of the evaporate. Although other gas flow distribution arrangements have been used, it has been found that the baffles 126 provide adequate gas flow distribution or uniformity while permitting ease of scaling up to large surfaces 102. The evaporate outlet 128 directs gas toward a glow discharge electrode 204 creating a glow discharge plasma from the evaporate. In the embodiment shown in FIG. 2, the glow discharge electrode 204 is placed in a glow discharge housing 200 having an evaporate inlet 202 proximate the evaporate outlet 128. In this embodiment, the glow discharge housing 200 and the glow discharge electrode 204 are maintained at a temperature above a dew point of the evaporate. By controlling a glow discharge parameter of power, voltage or a combination thereof, multiple carbon carbon bonds (double, triple or radical bonds) of the molecules within the evaporate are altered (usually broken to a lower number bond) thereby obtaining a faster reaction rate than for molecules having only single bonds.

The glow discharge plasma exits the glow discharge housing 200 and cryocondenses on the surface 102 of the substrate 104. The substrate 104 is generally kept at a temperature below a dew point of the evaporate, typically ambient temperature or cooled below ambient temperature to enhance the cryocondensation rate. In this embodiment, the substrate 104 is moving and may be electrically grounded, electrically floating, or electrically biased with an impressed voltage to draw charged species from the glow discharge plasma. If the substrate 104 is electrically biased, it may even replace the electrode 204 and be, itself, the electrode which creates the glow discharge plasma from the polymer precursor gas. Electrically floating means that there is no impressed voltage, although a charge may build up due to static electricity or due to interaction with the plasma.

Figure 2A:
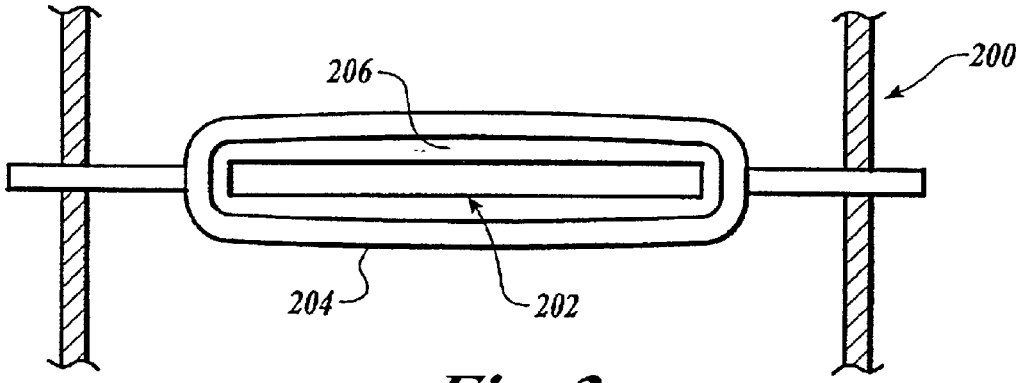
FIG. 2*a* is a cross section end view of the apparatus of FIG. 2.

A preferred shape of the glow discharge electrode 204, is shown in FIG. 2*a*. In this embodiment, the glow discharge electrode 204 is separate from the substrate 104 and shaped so that evaporate flow from the evaporate inlet 202 substantially flows through an electrode opening 206. Any electrode shape can be used to create the glow discharge, however, the preferred shape of the electrode 204 does not shadow the plasma from the evaporate issuing from the outlet 202 and its symmetry, relative to the polymer precursor exit slit 202 and substrate 104, provides uniformity of the evaporate vapor flow to the plasma across the width of the substrate while uniformity transverse to the width follows from the substrate motion.

The spacing of the electrode 204 from the substrate 104 is a gap or a distance that permits the plasma to impinge upon the substrate. This distance that the plasma extends from the electrode will depend on the evaporate species, electrode 204/substrate 104 geometry, electrical voltage and frequency, and pressure in the standard way as described in detail in ELECTRICAL DISCHARGES IN GASSES, F. M. Penning, Gordon and Breach Science Publishers, 1965, and summarized in THIN FILM PROCESSES, J. L. Vossen, W. Kern, editors, Academic Press, 1978, Part II, Chapter II-1, Glow Discharge Sputter Deposition, both hereby incorporated by reference.

Figure 3:
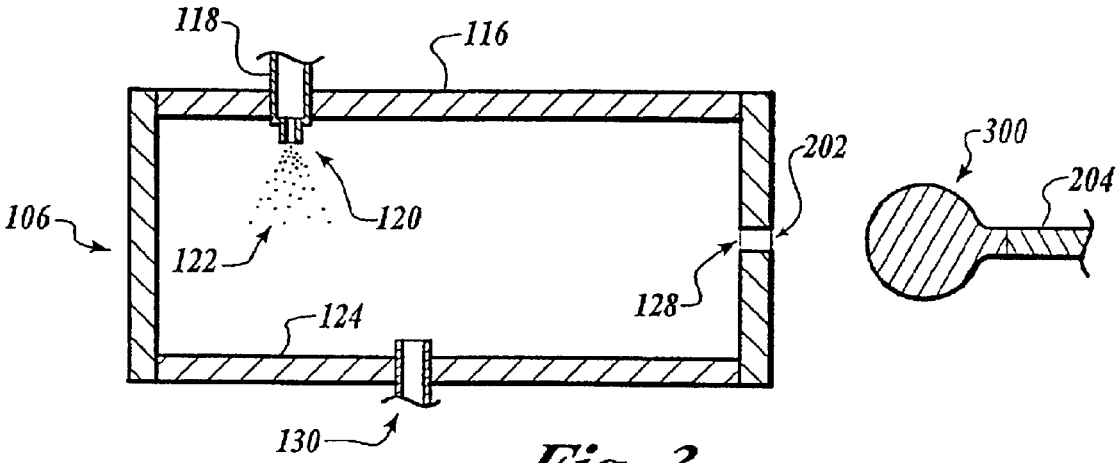
FIG. 3 is a cross section of an apparatus wherein the substrate is the electrode.
Figure 4:
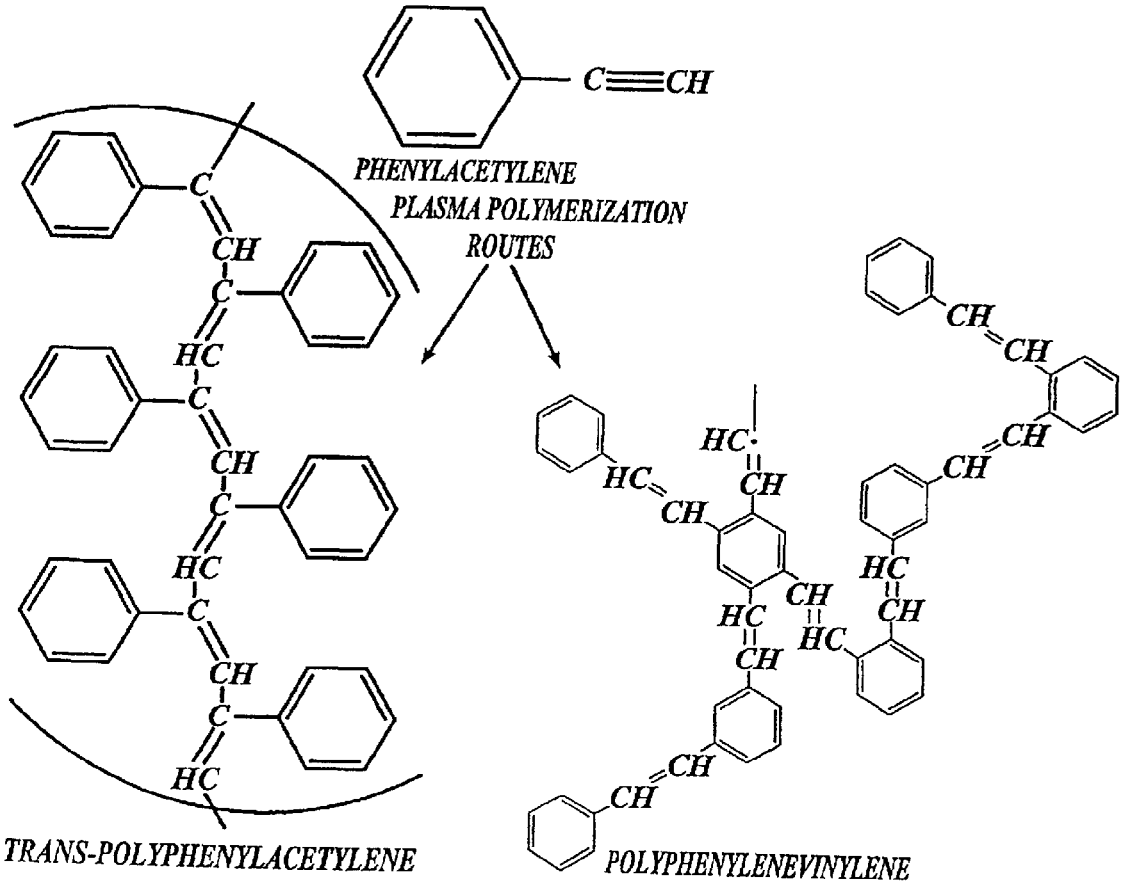
FIG. 4 is a chemical diagram of phenylacetylene and two plasma polymerization routes from phenylacetylene to conjugated polymer.

An apparatus suitable for batch operation is shown in FIG. 3. In this embodiment, the glow discharge electrode 204 is sufficiently proximate a part 300 (substrate) that the part 300 is an extension of or part of the electrode 204. Moreover, the part is below a dew point to allow cryocondensation of the glow discharge plasma on the part 300 and thereby coat the part 300 with the polymer precursor condensate and self cure into a polymer layer. Sufficiently proximate may be connected to, resting upon, in direct contact with, or separated by a gap or distance that permits the plasma to impinge upon the substrate. This distance that the plasma extends from the electrode will depend on the evaporate species, electrode 204/substrate 104 geometry, electrical voltage and frequency, and pressure in the standard way as described in ELECTRICAL DISCHARGES IN GASSES, F. M. Penning, Gordon and Breach Science Publishers, 1965, hereby incorporated by reference. The substrate 300 may be stationary or moving during cryocondensation. Moving includes rotation and translation and may be employed for controlling the thickness and uniformity of the polymer precursor layer cryocondensed thereon. Because the cryocondensation occurs rapidly, within milli-seconds to seconds, the part may be removed after coating and before it exceeds a coating temperature limit.

In operation, either as a method for plasma enhanced chemical vapor deposition of low vapor pressure materials onto a substrate, or as a method for making self-curing polymer layers (especially PML), the method of the invention includes flash evaporating a polymer precursor capable of crosslinking into the polymer with the selected index of refraction forming an evaporate, passing the evaporate to a glow discharge electrode creating a glow discharge polymer precursor plasma from the evaporate, and cryocondensing the glow discharge polymer precursor plasma on a substrate as a condensate and crosslinking the condensate thereon, the crosslinking resulting from radicals created in the glow discharge plasma.

The flash evaporating may be performed by supplying a continuous liquid flow of the polymer precursor into a vacuum environment at a temperature below both the decomposition temperature and the polymerization temperature of the polymer precursor, continuously atomizing the polymer precursor into a continuous flow of droplets, and continuously vaporizing the droplets by continuously contacting the droplets on a heated surface having a temperature at or above a boiling point of the liquid polymer precursor and of the molecular dopant, but below a pyrolysis temperature, forming the composite vapor. The droplets typically range in size from about 1 micrometer to about 50 micrometers, but they could be smaller or larger.

Alternatively, the flash evaporating may be performed by supplying a continuous liquid flow of the polymer precursor into a vacuum environment at a temperature below both the decomposition temperature and the polymerization temperature of the polymer precursor, and continuously directly vaporizing the liquid flow of the polymer precursor by continuously contacting the liquid polymer precursor on a heated surface having a temperature at or above the boiling point of the liquid polymer precursor, but below the pyrolysis temperature, forming the evaporate. This may be done using the vaporizer disclosed in U.S. Pat. Nos. 5,402,314, 5,536,323, and 5,711,816, which are incorporated herein by reference.

The evaporate is directed to a glow discharge that is controlled to alter material bonds to obtain a polymer with a desired index of refraction upon condensation and curing.

The liquid material may be any liquid polymer precursor. However, it is preferred that the liquid polymer precursor or liquid have a low vapor pressure at ambient temperatures so that it will readily cryocondense. The vapor pressure of the liquid polymer precursor material may be less than about 10 torr at 83° F. (28.3° C.), less than about 1 torr at 83° F. (28.3° C.), or less than about 10 millitorr at 83° F. (28.3° C.). For polymer precursors of the same chemical family, polymer precursors with low vapor pressures usually also have higher molecular weight and are more readily cryocondensible than higher vapor pressure, lower molecular weight polymer precursors. Liquid polymer precursors include, but are not limited to, (meth)acrylate, halogenated alkane, phenyl acetylene, and combinations thereof. Polymer precursors with aromatic rings or polymer precursors with multiple (double or triple) bonds (including conjugated monomers or particles) react faster than polymer precursors with only single bonds.

The particle(s) may be any soluble, insoluble, or partially soluble particle type having a boiling point below a temperature of the heated surface in the flash evaporation process. Soluble particles include, but are not limited to, substituted metal tris (N-R8-quinolinolato) chelates, wherein N is between 2 and 7 and is the substituent position of the ligand, and wherein R is H, alkyl, alkoxy, and fluorinated hydrocarbons; and substituted tertiary aromatic amines; such as, for example:

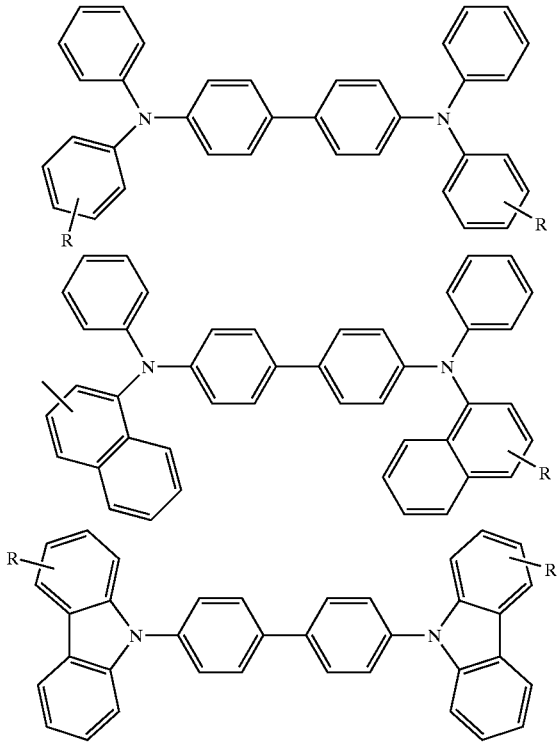

R = H, alkyl, alkoxy, and fluorinated hydrocarbons

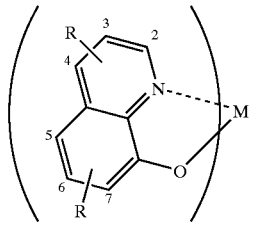

n = 3, M = $Al^{+3}$, $Ga^{+3}$, $In^{+3}$
n = 1, M = $Li^{+1}$
R = alkyl, alkoxy, and fluorinated hydrocarbons

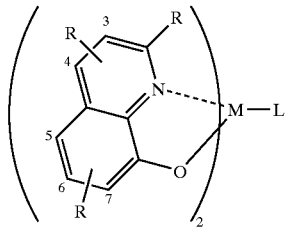

M = $Al^{+3}$, $Ga^{+3}$, $In^{+3}$
R = alkyl, alkoxy, and fluorinated hydrocarbons
L = monodentate ligand, such as carboxylate, phenolate and derivatives of.

Figure 5A:
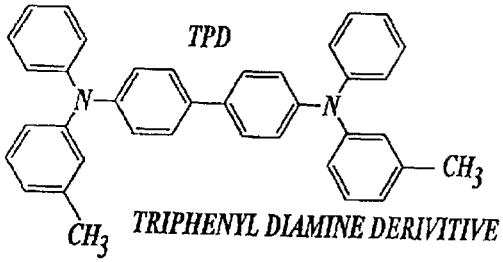
FIG. 5*a* is a chemical diagram of triphenyl diamine derivative.
Figure 5B:
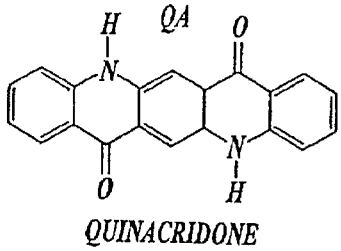
FIG. 5*b* is a chemical diagram of quinacridone.

Insoluble particles include, but are not limited to, triphenyl diamine derivatives (TPD, FIG. 5*a*), quinacridone derivatives (QA, FIG. 5*b*), and metal (8-quinolinolato chelates, such as aluminum quinolinolato (Alq), gallium quinolinolate (Gaq), and lithium quinolinate (Liq), and combinations thereof. Partially soluble means that some of the particles do not dissolve in the polymer precursor, including the situation in which a soluble particle is present in a concentration exceeding the solubility limit in the polymer precursor, so that some of the dissolvable material remains undissolved.

The insoluble particles generally have a volume much less than about 5000 cubic micrometers (diameter about 21 micrometers) or equal thereto, typically less than or equal to about 4 cubic micrometers (diameter about 2 micrometers). The insoluble particles may be sufficiently small with respect to particle density and liquid polymer precursor density and viscosity that the settling rate of the particles within the liquid polymer precursor is several times greater than the amount of time to transport a portion of the particle liquid polymer precursor mixture from a reservoir to the atomization nozzle. It may be necessary to agitate the particle liquid polymer precursor mixture in the reservoir to maintain suspension of the particles and avoid settling. As used herein, agitation includes, but is not limited to, stirring, physical shaking, ultrasonic vibration, and convection (thermal gradient).

The mixture of polymer precursor and soluble, insoluble, or partially soluble particles may be considered a solution, slurry, suspension or emulsion, and the particles may be solid or liquid. The mixture may be obtained by several methods. One method is to mix insoluble particles of a specified size into the polymer precursor. The insoluble particles of a solid of a specified size may be obtained by direct purchase or by making them by one of any standard techniques, including, but not limited to, milling from large particles, precipitation from solution, melting/spraying under controlled atmospheres, rapid thermal decomposition of precursors from solution as described in U.S. Pat. No. 5,652,192 hereby incorporated by reference. The steps of U.S. Pat. No. 5,652,192 are making a solution of a soluble precursor in a solvent and flowing the solution through a reaction vessel, pressurizing and heating the flowing solution and forming substantially insoluble particles, then quenching the heated flowing solution and arresting growth of the particles. Alternatively, larger sizes of solid material may be mixed into liquid polymer precursor then agitated, for example ultrasonically, to break the solid material into particles of sufficient size.

Liquid particles may be obtained by mixing an immiscible liquid with the polymer precursor liquid and agitating by ultrasonic or mechanical mixing to produce liquid particles within the liquid polymer precursor. Immiscible liquids include, for example phenylacetylene.

If an atomizer is used, upon spraying, the droplets may be particles alone, particles surrounded by liquid polymer precursor and liquid polymer precursor alone. Since both the liquid polymer precursor and the particles are evaporated, it is of no consequence either way. The droplets should be sufficiently small that they are completely vaporized. The droplet size may range from about 1 micrometer to about 50 micrometers, although they may be larger or smaller.

Materials useful for selective index of refraction (n) include, but are not limited to, aromatic ring compounds. For example, high index of refraction material may be obtained from lower index of refraction material as in the plasma alteration of diallyldiphenylsilane (n=1.575) (FIG. 6*a*) to polydiallylphenylsilane ($1.6 \leqq n \leqq 1.65$) (FIG. 6*b*). Alternatively, a lower index of refraction material may be made from a higher index of refraction material by plasma alteration of 1,3-divinyltetramethyldisiloxane (n=1.412) (FIG. 7*a*) to vinyltriethoxysilane (n=1.396) (FIG. 7*b*).

A material that is solid may be suspended in a liquid polymer precursor wherein the material cross links into the liquid polymer precursor to alter the index of refraction. Specifically, for example bi-phenyl may be suspended in any of the herein mentioned liquid polymer precursors (conjugated or not), resulting in phenyl, or multi-phenyl including, but not limited to, bi-phenyl, tri-phenyl and combinations thereof, which are cross linked molecules that increase the index of refraction compared to polymerizing the liquid polymer precursor alone.

Halogenated alkyl compounds may be useful for obtaining a selected index of refraction. Halogens include, but are not limited to, fluorine, bromine, chlorine and combinations thereof.

By using flash evaporation, the material is vaporized so quickly that reactions that generally occur from heating a liquid material to an evaporation temperature simply do not occur. Further, control of the rate of evaporate delivery is strictly controlled by the rate of material delivery to the inlet 118 of the flash evaporator 106.

In addition to the evaporate from the polymer precursor, additional gases may be added within the flash evaporator 106 through a gas inlet 130 upstream of the evaporate outlet 128, preferably between the heated surface 124 and the first baffle 126 nearest the heated surface 124. Additional gases may be organic or inorganic for purposes including, but not limited to, ballast, reaction, and combinations thereof. Ballast refers to providing sufficient molecules to keep the plasma lit in circumstances of low evaporate flow rate. Reaction refers to chemical reaction to form a compound different from the evaporate. Additional gases include, but are not limited to, group VIII of the periodic table, hydrogen, oxygen, nitrogen, chlorine, bromine, polyatomic gases including for example carbon dioxide, carbon monoxide, water vapor, and combinations thereof.

The method of the present invention may obtain a polymer layer by self-curing. In glow discharge ionization, a combined flash evaporator, glow discharge plasma generator is used without either the electron beam gun or ultraviolet light.

The present invention is insensitive to a direction of motion of the substrate because the deposited polymer precursor layer is self-curing. In addition, multiple layers of materials may be combined. For example, as recited in U.S. Pat. Nos. 5,547,508 and 5,395,644, 5,260,095, hereby incorporated by reference, multiple polymer layers, alternating layers of polymer and metal, and other layers may be made with the present invention in the vacuum environment.

While a preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

We claim:

1. A method of making a polymer layer having a selected index of refraction, the method using plasma enhanced chemical vapor deposition onto a substrate in a vacuum environment, comprising:

(a) providing a polymer precursor cross linkable into a polymer with the selected index of refraction;

(b) making an evaporate by receiving a plurality of polymer precursor particles as a spray into a flash evaporation housing, evaporating the polymer precursor on an evaporation surface, and discharging the evaporate through an evaporate outlet;

(c) making a polymer precursor plasma from the evaporate by passing the evaporate proximate a glow discharge electrode; and (d) cryocondensing the polymer precursor plasma onto the substrate as a condensate and crosslinking the condensate thereon, forming the polymer layer having the selected index of refraction.

2. The method as recited in claim 1, wherein the substrate is proximate the glow discharge electrode, and is electrically biased with an impressed voltage.

3. The method as recited in claim 1, wherein the glow discharge electrode is positioned within a glow discharge housing having an evaporate inlet proximate the evaporate outlet, the glow discharge housing and the glow discharge electrode maintained at a temperature above a dew point of the evaporate, and the substrate is downstream of the polymer precursor plasma, and is electrically floating.

4. The method as recited in claim 1, wherein the substrate is proximate the glow discharge electrode, and is electrically grounded.

5. The method as recited in claim 1, wherein the polymer precursor is selected from the group consisting of halogenated alkyl polymer precursors, diallyldiphenylsilane, 1,3-divinyltetramethyldisiloxane, (meth)acrylate polymer precursors, and phenylacetylene, and combinations thereof.

6. The method as recited in claim 1, wherein the substrate is cooled.

7. The method as recited in claim 1, further comprising adding an additional gas to the evaporate.

8. The method as recited in claim 7, wherein the additional gas is a ballast gas.

9. The method as recited in claim 7, wherein the additional gas is a reaction gas.

10. The method as recited in claim 9, wherein the reaction gas is oxygen gas.

11. The method as recited in claim 1, further comprising particles selected from the group consisting of organic solids, liquids, and combinations thereof.

12. The method as recited in claim 11, wherein the organic solids are selected from the group consisting of biphenyl, triphenyl diamine derivatives, quinacridone derivatives, and metal (8-quinolinolato) chelates, and combinations thereof.

13. The method as recited in claim 1, wherein flash evaporating comprises:

(a) supplying a continuous liquid flow of the polymer precursor material into a vacuum environment at a temperature below both the decomposition temperature and the polymerization temperature of the polymer precursor material;

(b) continuously atomizing the polymer precursor material into a continuous flow of droplets; and (c) continuously vaporizing the droplets by continuously contacting the droplets on a heated surface having a temperature at or above a boiling point of the polymer precursor material, but below a pyrolysis temperature, forming the evaporate.

14. The method as recited in claim 13 wherein the droplets range in size from about 1 micrometer to about 50 micrometers.

15. The method as recited in claim 1 wherein flash evaporating comprises:

(a) supplying a continuous liquid flow of the polymer precursor material into a vacuum environment at a temperature below both the decomposition temperature and the polymerization temperature of the polymer precursor material; and (b) continuously directly vaporizing the liquid flow of the polymer precursor material by continuously contacting the polymer precursor material on a heated surface having a temperature at or above a boiling point of the polymer precursor material, but below a pyrolysis temperature, forming the evaporate.

16. A method for making a polymer layer of a polymer with a selected index of refraction in a vacuum chamber, comprising:

(a) flash evaporating a polymer precursor material capable of cross linking into the polymer with the selected index of refraction, forming an evaporate;

(b) passing the evaporate to a glow discharge electrode creating a glow discharge polymer precursor plasma from the evaporate;

(c) cryocondensing the glow discharge polymer precursor plasma on a substrate as a condensate and crosslinking the condensate thereon, the crosslinking resulting from radicals created in the glow discharge polymer percursor plasma, forming the polymer layer having the selected index of refraction.

17. The method as recited in claim 16, wherein the substrate is proximate the glow discharge electrode, and is electrically biased with an impressed voltage.

18. The method as recited in claim 16, wherein the glow discharge electrode is positioned within a glow discharge housing having an evaporate inlet proximate the evaporate outlet, the glow discharge housing and the glow discharge electrode maintained at a temperature above a dew point of the evaporate, and the substrate is downstream of the polymer precursor plasma, and is electrically floating.

19. The method as recited in claim 16, wherein the substrate is proximate the glow discharge electrode and is electrically grounded.

20. The method as recited in claim 16, wherein the polymer precursor material is a conjugated polymer precursor.

21. The method as recited in claim 16, wherein the polymer precursor material is selected from the group consisting of halogenated alkyl polymer precursors, diallyldiphenylsilane, 1,3-divinyltetramethyldisiloxane, (meth)acrylate polymer precursors, and phenylacetylene, and combinations thereof.

22. The method as recited in claim 16, wherein the substrate is cooled.

23. The method as recited in claim 16, wherein the polymer precursor material is a polymer precursor containing particles.

24. The method as recited in claim 23, wherein the polymer precursor is a conjugated polymer precursor.

25. The method as recited in claim 23, wherein the particles are selected from the group consisting of organic solids, liquids, and combinations thereof.

26. The method as recited in claim 25, wherein the organic solids are selected from the group consisting of biphenyl, triphenyl diamine derivatives, quinacridone derivatives, and metal (8-quinolinolato) chelates, and combinations thereof.

* * * * *